United States Patent [19]

Hobrough

[11] Patent Number: 4,473,723

[45] Date of Patent: Sep. 25, 1984

[54] RIBBON LOUDSPEAKER HAVING CORREGATED RIBBON FOR REDUCING DISTORTION

[76] Inventor: Gilbert L. Hobrough, c/o Jumetite Laboratories, Ltd., 1300 Richard St., Vancouver, BC, Canada, V6B 3G6

[21] Appl. No.: 384,911

[22] Filed: Jun. 4, 1982

[51] Int. Cl.[3] ..... H04R 9/00

[52] U.S. Cl. ..... 179/115 V

[58] Field of Search ..... 179/115 V

[56] References Cited

U.S. PATENT DOCUMENTS

| | | | |
|---|---|---|---|
| 2,608,265 | 8/1952 | Eckardt | 179/115 V |
| 2,691,148 | 10/1954 | Schlenker | 179/115 V |
| 3,564,163 | 2/1971 | Hobrough | 179/115 V |

*Primary Examiner*—G. Z. Rubinson
*Assistant Examiner*—Danita R. Byrd
*Attorney, Agent, or Firm*—Robert Nathans

[57] ABSTRACT

A specially designed ribbon for a ribbon loudspeaker is disclosed which prevents ribbon snaking associated with prior art corregated ribbon. The elimination of snaking enables the use of extremely small gaps between the side edges of the ribbon and the magnetic pole pieces which in turn greatly reduce transient distortion of high fidelity sound. Relatively large amplitude corregations are formed within suspended terminal ribbon portions and substantially smaller amplitude corregations are formed within the suspended centralized ribbon portion.

19 Claims, 3 Drawing Figures

RIBBON LOUDSPEAKER HAVING CORREGATED RIBBON FOR REDUCING DISTORTION

BACKGROUND OF THE INVENTION

This invention relates to the field of ribbon loudspeakers.

During extensive experimentation with ribbon loudspeakers, I have discovered that by reducing the gap between the side edges of the ribbon and the magnetic poles to distances of about 5 mils, a substantial reduction in the degree of harmonic sound distortion is produced relative to larger gaps in the neighborhood of 15–20 mils. I have determined experimentally that if the gaps between the ribbon edges and the poles are about six to seven mils, the third harmonic distortion is only 2% at about 1,000 cycles per second. In contrast, gaps of about 15 mils produced third harmonic distortion of 7% at about 1,000 cycles per second. Further gap reduction to about 3 mils produced a third harmonic distortion of 0.3% at about 1,000 cycles. The relatively large gaps of about 15 mils cause a pumping action of the air passing through the gaps during ribbon vibration which in turn produces turbulence, which is responsible for the increased distortion of reproduced sound. In my U.S. Pat. No. 3,564,163, incorporated by reference herein, I discuss at the bottom of Column 2 and the top of Column 3 the function of the transverse corregations which are advantageously formed within the ribbon.

The transversely formed corregations discussed and illustrated in the above mentioned patent, although deemed desirable to provide resilience because they allow the ribbon to be deflected back and forth without being permanently stretched, create difficulty in attempting to maintain the above mentioned desirable gap in the neighborhood of about 5 mils. This is because the ribbon will laterally shift about or "snake" due to what I call an "accordian" effect owing to the corregations, and the "snaking" will cause the edges of the ribbon to strike the pole pieces which produces ribbon damage and undesirable sound distorting clattering. Furthermore, the striking of one pole piece by one ribbon edge portion during "snaking" will result in an enlargement of the gap at the opposite edge portion, producing the spillage of a significant body of air through the enlarged gap, to in turn generate the aforementioned detrimental turbulence.

Thus, it is an object of the present invention to enable the use of greatly reduced gaps of about 5 mils to dramatically reduce sound distortion by preventing the above mentioned lateral ribbon shifting or "snaking" phenomenon.

At the top of Column 3 of the above mentioned patent, I briefly suggest a stiffening of the central ribbon portions by "longtitudinal corregations or dimpling." The use of longtitudinal corregations, oriented perpendicular to the transverse corregations at the terminal portions, was attempted to eliminate "snaking" and was unsatisfactory because undue stress was set up at the discontinuous boundary between the transverse corregations and the longtitudinal corregations, which in turn caused serious ribbon damage; likewise with respect to the dimpling approach, which involved forming dimples in the centralized ribbon portion. I have also attempted to form transverse corregations at terminal ribbon portions and eliminate all corregations at the centralized portion. The result is crinkling of the ribbon with accompanying distortion of sound. By shaking a thin sheet of ordinary kitchen aluminum foil, this crinkling sound may be heard.

SUMMARY OF AN EMBODIMENT OF THE INVENTION

The above mentioned objects were accomplished by providing a ribbon having relatively large amplitude and relatively low spatial frequency corregations formed within terminal portions thereof and having relatively small amplitude and relatively high spacial frequency frequency corregations formed within the centralized portion, all of said corregations being substantially perpendicular with respect to the length of the ribbon and parallel to each other. The resulting ribbon configuration virtually eliminated the above mentioned detrimental "snaking", which additionally permitted the employment of greatly reduced air gaps as mentioned above, thereby to dramatically reduce harmonic distortion in the sound produced by the ribbon loudspeaker.

Other objects, features and advantages of the present invention will become apparent upon study of the following description taken in conjunction with the drawings, in which.

DETAILED DESCRIPTION

Figure 3:
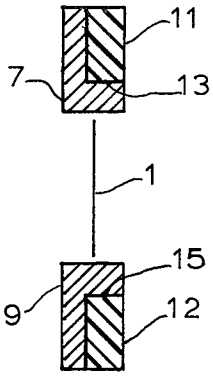
FIG. 3 illustrates a second sectional view.
Figure 2:
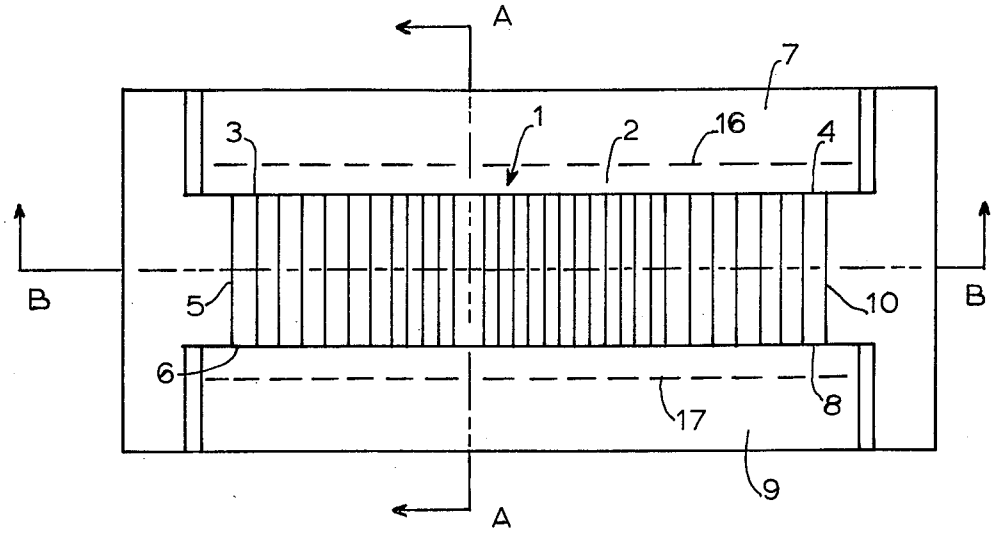
FIG. 2 shows a top view of an embodiment of the invention.
Figure 1:
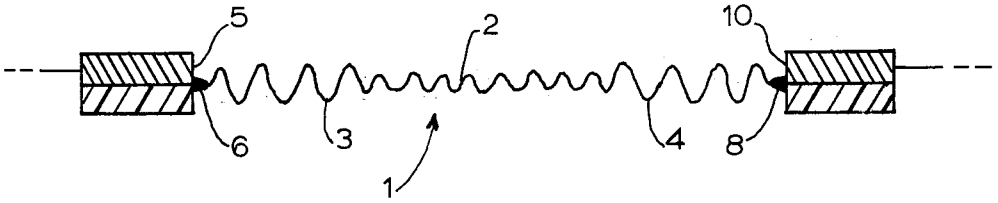
FIG. 1 shows a side sectional view of an embodiment of the invention.

In FIGS. 1 and 2 a ribbon 1 is illustrated having a suspended centralized section 2 and suspended terminal sections 3 and 4. Extreme ribbon portions 6 and 8 are affixed to stationary current conductor members 5 and 10. The ribbon module of FIG. 2 is suspended between means for generating a magnetic field oriented in a direction parallel to the major planar surfaces of the ribbon (see my U.S. Pat. No. 3,564,163 mentioned above). A pair of magnetically permeable or magnetized side rails 7 and 9 are glued or otherwise affixed to insulators 11 and 12 shown in FIGS. 2 and 3. Boundaries 13 and 15 of FIG. 3 formed between the magnetic side rails and the insulating substrate are shown by dotted lines 16 and 17 in FIG. 2. FIG. 3 is a section taken through A—A′ whereas FIG. 1 is a section taken through B—B′. The function of side rails 7 and 9 is to convey magnetic flux from the magnet members (not shown) to positions in space very closely adjacent the side edges of the ribbon forming tiny gaps as illustrated in FIG. 3.

The above stated objects of the invention are accomplished by providing relatively high amplitude corregations at the terminal portions, 3 and 4, of the ribbon and relatively low amplitude corregations at the suspended centralized portion 2 of the ribbon, as illustrated in FIGS. 1 and 2. Preferably, the peak to trough distances of the large corregations are in the neighborhood of about 50 mils, whereas the peak to trough amplitude of the small corregations are preferably about 5 mils. The spacial frequency of the large corregations along the length of the ribbon is preferably about 10 corregations per linear inch and the spacial frequency of the small corregations are preferably about 50 corregations per linear inch. It is not, however, believed that these parameters are highly critical. All of the corregations are preferably substantially parallel to each other as illustrated in FIG. 2 and thus, substantially perpendicular to the side edges of the ribbon. Due to the above stated ribbon configuration, the above mentioned detrimental stresses between the centralized ribbon portion and the terminal ribbon portions are not produced. These corregations could be formed, for example, by employing a pair of mating gear-like rollers which receive the ribbon at the roller interfaces. Other methods, could of course, be used to effect the corregations. Thus, the above-stated objects of the invention have been accomplished and no detrimental stresses are produced in the ribbon to damage it.

In the ribbon loudspeakers manufactured for commercial use by my company, an aluminum foil ribbon is provided having a suspended length of three inches, a width of $\frac{3}{4}$ inch, and a thickness of 0.4 mils. Each terminal section extends about $\frac{1}{2}$ inch along the suspended length of the ribbon so that the suspended central section is about 2 inches.

It should be understood that other components and configurations may be substituted for those described in order to practice the invention, and the invention is to be limited only by the permissible scope of the following claims.

I claim:

1. In a ribbon loudspeaker having a sound radiating ribbon conductor suspended lengthwise between magnetic pole pieces, said ribbon having suspended terminal portions and a suspended centralized portion between said terminal portions, said ribbon being positioned with respect to said pole pieces so that gaps are formed between said pole pieces and the longtitudinally extending side edges of said ribbon, said ribbon having relatively large amplitude transverse corregations formed within said suspended terminal ribbon portions and relatively small amplitude transverse corregations formed within said centralized ribbon portion.

2. The combination as set forth in claim 1 wherein the amplitudes of said corregations formed within said terminal portion are about 50 mils from peak to trough, and the amplitudes of said corregations formed within said centralized portion are about two to five mils from peak to trough.

3. The combination as set forth in claim 1 wherein the length of said centralized portion is about one-half to three-quarters of the entire suspended length of said ribbon.

4. The combination as set forth in claim 2 wherein the length of said centralized portion is about one-half to three-quarters of the entire suspended length of said ribbon.

5. The combination as set forth in claims 1, 2, 3 or 4 wherein said corregations formed within said terminal ribbon portions have a spacial frequency of about 10 corregations per linear inch along the length of said ribbon, and said corregations formed within said centralized ribbon portion have a spacial frequency of about 50 corregations per linear inch along the length of said ribbon.

6. The combination as set forth in claims 1, 2, 3 or 4 wherein said gaps between the longtitudinally extending side edges of said ribbon and said pole pieces are about three to seven mils.

7. The combination as set forth in claim 5 wherein said gaps between the longtitudinally extending side edges of said ribbon and said pole pieces are about three to seven mils.

8. In a ribbon loudspeaker having a sound radiating ribbon conductor suspended lengthwise between magnetic pole pieces, said ribbon having suspended terminal portions and a suspended centralized portion between said terminal portions, said ribbon being positioned with respect to said pole pieces and the longtitudinally extending side edges of said ribbon, said ribbon having relatively large amplitude transverse corregations formed within said suspended terminal ribbon portions perpendicular to said side edges of said ribbon and relatively small amplitude transverse corregations formed within said centralized ribbon portion perpendicular to said side edges of said ribbon.

9. The combination as set forth in claim 8 wherein the amplitudes of said corregations formed within said terminal portion are about 50 mils from peak to trough, and the amplitudes of said corregations formed within said centralized portion are about two to five mils from peak to trough.

10. The combination as set forth in claim 8 wherein the length of said centralized portion is about one half to three quarters of the entire suspended length of said ribbon.

11. The combination as set forth in claim 9 wherein the length of said centralized portion is about one half to three quarters of the entire suspended length of said ribbon.

12. The combination as set forth in claims 8, 9, 10 or 11 wherein said corregations formed within said terminal ribbon portions have a spacial frequency of about 10 corregations per linear inch along the length of said ribbon, and said corregations formed within said centralized ribbon portion have a spacial frequency of about 50 corregations per linear inch along the length of said ribbon.

13. The combination as set forth in claims 8, 9, 10 or 11 wherein said gaps between the longtitudinally extending side edges of said ribbon and said pole pieces are about three to seven mils.

14. The combination as set forth in claim 12 wherein said gaps between the longtitudinally extending side edges of said ribbon and said pole pieces are about three to seven mils.

15. In a ribbon loudspeaker having a sound radiating ribbon conductor suspended lengthwise between magnetic pole pieces, said ribbon having suspended terminal portions and a suspended centralized portion between said terminal portions, said ribbon being positioned with respect to said pole pieces so that gaps are formed between said pole pieces and the longtitudinally extending side edges of said ribbon, said ribbon having relatively large amplitude transverse corregations formed within said suspended terminal ribbon portions substantially perpendicular to said side edges of said ribbon and relatively small amplitude transverse corregations formed within said centralized ribbon portion substantially perpendicular to said side edges of said ribbon, and wherein the amplitudes of said corregations formed within said terminal portion are about 50 mils from peak to trough, and the amplitudes of said corregations formed within said centralized portion are substantially smaller than 50 mils.

16. The combination as set forth in claim 15 wherein the length of said centralized portion is about one half to three quarters of the entire suspended length of said ribbon.

17. The combination as set forth in claims 15 or 16 wherein said corregations formed within said terminal ribbon portions have a spacial frequency of about 10 corregations per linear inch along the length of said ribbon, and said corregations formed within said centralized ribbon portion have a spacial frequency substantially higher than 10 mils per linear inch along the length of said ribbon.

18. The combination as set forth in claims 15 or 16 wherein said gaps between the longtitudinally extending side edges of said ribbon and said pole pieces are about three to seven mils.

19. The combination as set forth in claim 18 wherein said gaps between the longtitudinally extend side edges of said ribbon and said pole pieces are about three to seven mils.

* * * * *